US009984633B2

(12) United States Patent
Park

(10) Patent No.: US 9,984,633 B2
(45) Date of Patent: May 29, 2018

(54) DISPLAY APPARATUS AND CONTROLLING METHOD THEREOF

(71) Applicant: SAMSUNG ELECTRONICS CO., LTD., Suwon-si (KR)

(72) Inventor: Sang-young Park, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 63 days.

(21) Appl. No.: 14/930,868

(22) Filed: Nov. 3, 2015

(65) Prior Publication Data

US 2016/0125813 A1 May 5, 2016

(30) Foreign Application Priority Data

Nov. 3, 2014 (KR) ..... 10-2014-0151290

(51) Int. Cl.
*G09G 3/34* (2006.01)

(52) U.S. Cl.
CPC ..... *G09G 3/344* (2013.01); *G09G 2310/061* (2013.01); *G09G 2320/0257* (2013.01); *G09G 2320/0271* (2013.01); *G09G 2340/14* (2013.01); *G09G 2340/16* (2013.01)

(58) Field of Classification Search
None
See application file for complete search history.

(56) References Cited

U.S. PATENT DOCUMENTS

| | | | | |
|---|---|---|---|---|
| 8,723,858 | B2 | 5/2014 | Yamada | |
| 2007/0164946 | A1* | 7/2007 | Akutsu | G09G 3/36 345/87 |
| 2011/0187766 | A1 | 8/2011 | Yamada | |
| 2012/0194570 | A1* | 8/2012 | Muto | G09G 3/344 345/690 |
| 2012/0254645 | A1 | 10/2012 | Jeganathan et al. | |
| 2013/0235061 | A1 | 9/2013 | Sadasue | |

FOREIGN PATENT DOCUMENTS

| | | | |
|---|---|---|---|
| JP | 2012-063551 | A | 3/2012 |
| JP | 2012-159786 | A | 8/2012 |
| JP | 5151547 | B2 | 2/2013 |
| JP | 2013-213913 | A | 10/2013 |

* cited by examiner

*Primary Examiner* — Nicholas J Lee
*Assistant Examiner* — Duane N Taylor, Jr.
(74) *Attorney, Agent, or Firm* — Sughrue Mion, PLLC

(57) ABSTRACT

A display apparatus and method are provided. The display apparatus includes a display, a storage which stores afterimage modeling information the includes afterimage information based on grayscale changes in a plurality of image frames, and a controller which controls the display to consecutively display the plurality of image frames and pixel-wise refresh pixels for afterimage removal in each image frame based on the afterimage modeling information. Therefore, flickering of a display screen can be reduced and the viewing fatigue of a user can decrease when the screen is converted.

17 Claims, 7 Drawing Sheets

FIG. 6

| | PREVIOUS FRAME INPUT GRAY | CURRENT FRAME UPDATE TARGET GRAY | CURRENT FRAME UPDATE RESULTANT GRAY | | |
|---|---|---|---|---|---|
| | Quantized value | | MEASURED BRIGHTNESS VALUE | Quantized value | |
| Case1 → | 0 | 128 | 115.2 | 128 | 610 |
| Case2 → | 0 | 144 | 123.5 | 144 | 620 |
| Case3 → | 144 | 128 | 118.8 | 136 | 630 |

DISPLAY APPARATUS AND CONTROLLING METHOD THEREOF

CROSS-REFERENCE TO RELATED APPLICATION(S)

This application claims priority from Korean Patent Application No. 10-2014-0151290, filed on Nov. 3, 2014, in the Korean Intellectual Property Office, the disclosure of which is incorporated herein by reference in its entirety.

BACKGROUND

1. Field

Apparatuses and methods consistent with exemplary embodiments relate to a display apparatus and a controlling method thereof, and more specifically, to a display apparatus and method that are configured to provide a more natural conversion of a screen with less delay.

2. Description of Related Art

Currently there are many types of display apparatuses that are being developed and distributed along with the rapid advancement of electronic technology. For example, large-screen flat display apparatuses such as liquid crystal displays (LCD) or plasma display panels (PDP) display have recently become widely distributed for home use as well as for commercial use.

Among the various types of display apparatuses, an electrophoretic display (EPD) refers to a display apparatus that implements a screen by moving white and black particles within substrates according to an electric principle.

EPDs are typically thin, support long battery life, have high contrast, and do not necessarily use a fast refresh speed or color. A common example of an electrophoretic display is e-paper. Other examples of EPD applications are watches, cell phones, wearable displays, and dynamic keypads.

EPDs may have an advantage in that eye fatigue is seldom experienced by a user and the power loss of the display is minimal. Thus, an EPD is widely applied in wearable devices that have good mobility, digital papers, and the like, in which power consumption is beneficial and in which contrast is also beneficial.

However, EPDs may have a disadvantage in that they may struggle to implement video without some sort of interruption or delay. For example, an image update time for an EPD may be relatively large, making it difficult for the EPD to show rapid movement fluently. In addition, afterimages may occur when the screen of the EPD is converted repeatedly. An afterimage is a type of optical illusion in which an image continues to appear briefly even after exposure to the actual image has ended.

In an effort to solve these problems, a related technology converts and displays a screen after applying a voltage to the entire screen and performing refreshing. However, the related technology has a problem in that the screen may flicker. Therefore, it is desirable to reduce the flickering of the screen when being converted.

SUMMARY

Exemplary embodiments of the present inventive concept overcome the above disadvantages and other disadvantages not described above. Also, one or more of the exemplary embodiments are not required to overcome the disadvantages described above, and an exemplary embodiment of the present inventive concept may not overcome any of the problems described above.

According to an aspect of an exemplary embodiment, provided herein is a display apparatus and method configured to perform a refresh function in a pixel-wise fashion to remove afterimages of a previous screen in a pixel-wise manner when converting the screen.

According to an aspect of an exemplary embodiment, provided is a display apparatus including a display, a storage configured to store afterimage modeling information comprising afterimage information based on grayscale changes in a plurality of image frames, and a controller configured to control the display to consecutively display the plurality of image frames and to refresh pixels for afterimage removal in each of the image frames, based on the afterimage modeling information.

While the plurality of the image frames are consecutively displayed and the respective image frames are converted, the controller may determine afterimages of previous image frames pixel-wise based on the afterimage modeling information and the pixels for afterimage removal may be refreshed according to the determined results.

The afterimage modeling information may include models of values associated with afterimages that are calculated frame-wise based on grayscale changes that can occur frame-wise.

The controller may determine values of the afterimages of the previous image frames pixel-wise using the afterimage modeling information based on a grayscale of a current image frame and a history of respective grayscales of the previous image frames.

The controller may pixel-wise refresh pixels that have values of afterimages in the previous image frames that are equal to or greater than a preset critical value.

The controller may display the current image frame by inputting the grayscale values of the current image frame pixel-wise after the pixel-wise refreshing.

The controller may include a frame grayscale acquirer configured to obtain a grayscale of an Nth image frame, and an internal memory configured to store a history of respective grayscales of (N−1) frames displayed before the Nth image frame.

The controller may determine values of afterimages of the (N−1)th image frame pixel-wise, using the afterimage modeling information based on the grayscale of the Nth image frame and the history of respective grayscales of the (N−1) frames.

The controller may determine whether grayscale values classified by a preset standard are used or not for the grayscales input pixel-wise, based on a grayscale of the current image frame, a history of respective grayscales of the previous image frames, and the afterimage modeling information.

The controller may pixel-wise refresh the pixels for afterimage removal in each image frame, in response to the values classified by the preset standard being used for the grayscales input pixel-wise.

When the values classified by the preset standard are not used for the grayscales input pixel-wise, the controller may update the pixels which have afterimages occurring in each image frame, to values which are not classified by the preset standard using the afterimages.

The controller may update the pixels in which afterimages occur in each image frame with the values which are not classified by the preset standard based on the values of the afterimages and a grayscale of the current image frame.

According to an aspect of another exemplary embodiment, provided is a controlling method of a display apparatus, the method including displaying a plurality of image frames consecutively and determining pixels for afterimage removal in each image frame based on previously stored afterimage modeling information comprising afterimage information based on grayscale changes in the plurality of image frames, and refreshing the pixels determined for afterimage removal pixel-wise.

While the plurality of the image frames are consecutively displayed and each image frame is converted, the determining may include determining the afterimages of previous image frames pixel-wise based on the afterimage modeling information, and the refreshing may include refreshing the pixels determined for afterimage removal according to the determined results.

The afterimage modeling information may include models of the values of afterimages calculated frame-wise based on grayscale changes that can occur frame-wise.

The determining may include determining values of the afterimages of the previous image frames pixel-wise using the afterimage modeling information based on a grayscale of the current image frame and a history of respective grayscales of the previous image frames.

The refreshing may include pixel-wise refreshing pixels which have values of afterimages in the previous image frames that are equal to or greater than a preset critical value.

The method may further include, after the refreshing pixel-wise, displaying the current image frame by inputting the grayscale values of the current image frame pixel-wise.

The method may further include determining whether grayscale values classified by a preset standard are used or not regarding the grayscales input pixel-wise based on a grayscale of the current image frame, a history of respective grayscales of the previous image frames, and the afterimage modeling information.

The method may further include pixel-wise refreshing the pixels determined for afterimage removal in each image frame in response to the values classified by the preset standard being used for the grayscales input pixel-wise, and updating the pixels having the afterimages occurring, with grayscale values which are not classified by the preset standard, using the afterimages, in response to the grayscale values classified by the preset standard not being used for the grayscales input pixel-wise.

According to one or more of the exemplary embodiments, the flickering of a screen may be reduced and a viewing fatigue of a user can decrease when the screen is converted. Also, the sensed velocity of a user can be enhanced, and the power loss of a display can be reduced.

BRIEF DESCRIPTION OF THE DRAWINGS

The above and/or other aspects of the present inventive concept will be more apparent by describing certain exemplary embodiments with reference to the accompanying drawings, in which:

FIG. 6 is a diagram illustrating values of a middle grayscale expressed using the afterimages according to an exemplary embodiment.

DETAILED DESCRIPTION

Figure 1:
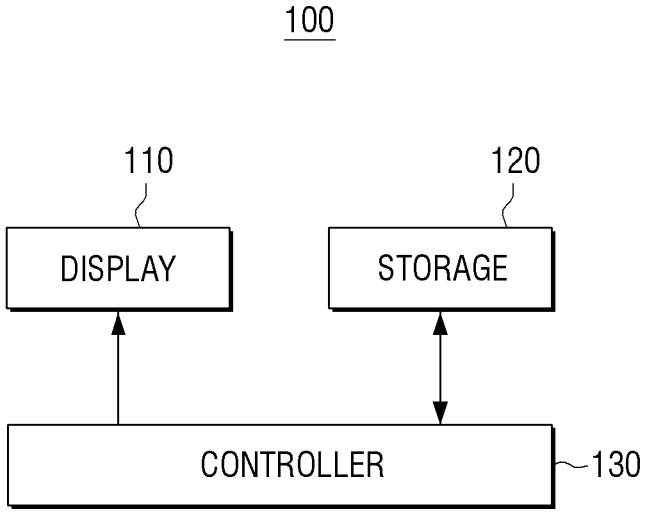
FIG. 1 is a block diagram of a display apparatus according to an exemplary embodiment.

Certain exemplary embodiments of the present inventive concept will now be described in greater detail with reference to the accompanying drawings.

In the following description, the same drawing reference numerals are used for the same elements, even in different drawings. The matters defined in the description, such as the detailed construction and elements, are provided to assist the reader in a comprehensive understanding of the present inventive concept. Accordingly, it should be apparent that the exemplary embodiments of the present inventive concept may be carried out without those specifically defined matters. Also, well-known functions or constructions are not described in detail because they would obscure the invention with unnecessary detail.

FIG. 1 is a block diagram of a display apparatus according to an exemplary embodiment.

Referring to FIG. 1, the display apparatus 100 includes a display 110, a storage 120, and a controller 130. As a non-limiting example, the display apparatus 100 may be implemented as or included in various electronic devices such as a TV, an electronic board, an electronic table, a large format display (LFD), a smart phone, a tablet, a desktop PC, a laptop, an electrophoretic display (EPD), an e-paper, a wearable display, a flexible display, a combination thereof, and the like.

According to one or more exemplary embodiments, the display apparatus 100 may be used for addressing a problem of screen flickering that typically occurs during screen conversion of a display apparatus. This problem is common in an electrophoretic display (EPD) which does not use very much power and which can have a slower refresh rate than some other display apparatuses. Accordingly, in some of the examples herein, for convenience, the display apparatus 100 may be referred to as an electrophoretic display apparatus or EPD.

The electrophoretic display apparatus is a display panel that uses electrophoresis. Electrophoresis is a phenomenon in which colloid particles move toward an electrode on any side because the particles carry electricity. For example, an electrophoretic display apparatus may be implemented using features in which the moving velocity of the particles is different according to size and form of the particles or according to a type and a density of the electrolytes in a solution.

For example, EPDs may use microcapsules filled with a suspension of charged pigment particles. The microcapsules may be sandwiched between two parallel conducting electrode panels. At least one of these panels may be transparent, so the microcapsules may be exposed to visible light.

Dependent on the charge given to the panels, the charged particles may move to a top or bottom of the display. This may cause either white or black particles to be visible. For example, visible light that hits the top of a microcapsule may be either scattered (creating white) or absorbed (creating black). In this way, EPDs rely on the scattering and absorption of light similar to ink on paper.

As an example, in response to putting water or another aqueous solutions in a container, solid fine particles or air bubbles of the aqueous solution, which are not mixed with the water or other aqueous solution, may be suspended. As the electrodes are inserted, due to the application of a direct current voltage, the particles in the aqueous solution may move through the aqueous solution while being electrically charged, and drawn toward the electrodes. The electrified polarity may be different depending on a type of the materials, and thus, the phoretic electrodes may be drawn toward a cathode or an anode. As described, being drawn toward the cathode is referred to as cataphoresis and being drawn toward the anode is referred to as anaphoresis.

In an example in which the display apparatus 100 is an electrophoretic display apparatus, the display apparatus 100 may display colors of white, black, and grayscales, by applying a voltage for a plurality of white and black particles that are provided pixel-wise within the display, and by controlling movement of the white and black particles.

For example, e-paper typically includes bendable materials that are used as a substrate instead of glass, thus providing a feeling of an ordinary sheet of paper. For example, by using a plastic material, the display may bend easily and may be resistant to breaking. Also, because e-paper may be as thin as a sheet of paper, it may be rumpled, creased, folded, and the like, thus increasing portability. Additionally, power consumption or power loss may be minimal because electronic ink is used instead of liquid crystal, thus, an image can be viewed with an external light alone, without the use of light illuminating from the back of the screen such as a backlight that is necessary for other displays. Furthermore, even though image quality may not be better than a LCD, the screen of the e-paper may be maintained after power is turned off, whereas the screen of a LCD closes instantly after the power is turned off.

As an example, when an e-paper generates a display by using a grayscale of colors, the e-paper may apply a voltage to a plurality of pixels that are included in the screen and express the grayscale of colors. For example, each pixel may include a plurality of white and black particles. Thus, the grayscale of colors may be expressed according to a distribution ratio of the distribution of white and black particles which may be varied according to an applied voltage.

Meanwhile, the display 110 may consecutively display a plurality of image frames. As an example, the display 110 may be implemented as a liquid crystal display (LCD), an organic light emitting display (OLED), a plasma display panel (PDP), and the like.

According to one or more exemplary embodiments, the storage 120 may store afterimage modeling information. For example, the afterimage modeling information may include values that are modeled regarding possible afterimages that are calculated frame-wise based on the grayscale changes that may occur frame-wise.

For example, when a first, second, third, and fourth image frames are consecutively displayed, the afterimage modeling information may include data that is obtained by calculating and mapping the afterimage values frame-wise, by considering every case in which grayscale values can be varied frame-wise based on all the grayscale values that can be input frame-wise.

For example, when the grayscale of the first frame is set to 128, the grayscale of the second frame is set to 144, the grayscale of the third frame is set to 0, and the grayscale input to the fourth frame is 255, the afterimages to be displayed on the fourth frame may be digitized and stored. As another example, when the grayscale of the first frame is set to 0, the grayscale of the second frame is set to 128, the grayscale of the third frame is set to 144, and the grayscale input to the fourth frame is 0, the afterimages to be displayed on the fourth frame may be digitized and stored. In the above-explained manner, the afterimages that are displayed frame-wise may be digitized based on all of the grayscale values that can be set frame-wise. Further, the data regarding the digitized afterimages may be stored in the storage 120 as the afterimage modeling information.

As a non-limiting example, afterimage modeling information may be stored in the storage 120 in firmware during a designing stage of the display apparatus 100. As another example, the afterimage modeling information may be stored in an external server (not illustrated) and be downloaded and stored by the display apparatus 100. Further, the information about the afterimage modeling that is stored in the external server may be updated periodically, and may be provided to the display apparatus 100.

The controller 130 may control the display 110 to consecutively display a plurality of image frames. The controller 130 may also control the display 110 to pixel-wise refresh pixels in which afterimage removal is to be performed in each image frame based on the afterimage modeling information. For example, the refresh function at the controller 130 may include shaking of a plurality of white and black particles that are provided pixel-wise by continuously modifying a polarity of the applied voltage.

As previously described, a related technology has a problem in which the refresh is performed frame-wise when the screen is converted. Therefore, in the related technology, the next screen is displayed only after the whole screen is flickered.

According to one or more exemplary embodiments, however, the controller 130 of the display apparatus 100 may control the display 110 to perform refreshing pixel-wise instead of frame-wise. Thus, a flickering of the whole screen caused in the related technology may be prevented by performing refreshing pixel-wise on only the pixels which need afterimage removal or which are set for afterimage removal. For example, pixel-wise may refer to performing a determination on a pixel-by-pixel basis to identify only those pixels in a frame that are to be refreshed. In contrast, frame-wise may refer to performing a refresh on every pixel in a frame.

The controller 130 may determine afterimages of previous image frames, pixel-wise, based on afterimage modeling information, in response to a plurality of image frames being consecutively displayed and the plurality of image frames being respectively converted. The controller 130 may also cause the pixels in need of afterimage removal according to be refreshed according to the determined results.

As an example, when a first image frame and a second image frame are consecutively displayed, and when the first image frame is converted into the second image frame, the controller 130 may determine the afterimage of the first image frame, pixel-wise, based on the afterimage modeling information. Also, the controller 130 may refresh the pixels corresponding to the afterimages that have a high possibility of being displayed noticeably to the eyes of a user from among the afterimages displayed on the second image frame according to the determined results.

Further provided herein is an example of a process at the controller 130 for determining the afterimages of the previous image frames, pixel-wise, based on the afterimage modeling information. For example, the controller 130 may determine values associated with the afterimages of the previous image frames pixel-wise using the afterimage modeling information based on a grayscale of a current image frame and a history of previous image frames.

The afterimage modeling information may be values that are modeled regarding the afterimages that are calculated frame-wise based on the grayscale changes that can occur frame-wise. For example, the controller 130 may use the afterimage modeling information based on history of the grayscales of the respective previous image frames and the grayscale of the image frame that is to be displayed currently. In this example, the controller 130 may determine an influence of the grayscales of the previous image frames on the image frame that is to be displayed currently.

According to one or more exemplary embodiments, when the influence of the grayscale of a previous image frame is large enough to be noticeably recognized by the eyes of a user on the image frame that is to be displayed currently, the controller 130 may determine that the afterimage is to be removed. Otherwise, if the influence of the grayscale of the previous images frame is not big enough to be noticed by the eyes of a user on the image frame that is to be displayed currently, the controller 130 may determine that the afterimage is not to be removed.

For example, the controller 130 may determine whether a value of an afterimage regarding a previous image frame is equal to or greater than a preset critical value. In this example, the controller 130 may determine that the afterimage is noticeable to the eyes of a user and is to be removed when the value of the afterimage regarding the previous image frame is equal to or greater than a preset critical value or some threshold value. Otherwise, when the value of the afterimage of the previous image frame is less than a critical value, the controller 130 may determine that an afterimage is not noticeable to the eyes of a user and is not to be removed.

In an example in which the first, the second, the third, and the fourth image frames are consecutively displayed, and when the third image frame is converted into the fourth image frame, the controller 130 may determine the afterimages of the third image frame pixel-wise using the afterimage modeling information that is based on a history of the grayscales of the first, second, third, and fourth image frames, respectively, and may refresh the pixels corresponding to the afterimages that have a high possibility of being noticeably to the eyes of a user from among the afterimages displayed on the fourth image frame according to the determined results.

Meanwhile, the controller 130 may display the current image frame by inputting the grayscale values of the current image frame pixel-wise after performing refreshing pixel-wise.

Figure 2:
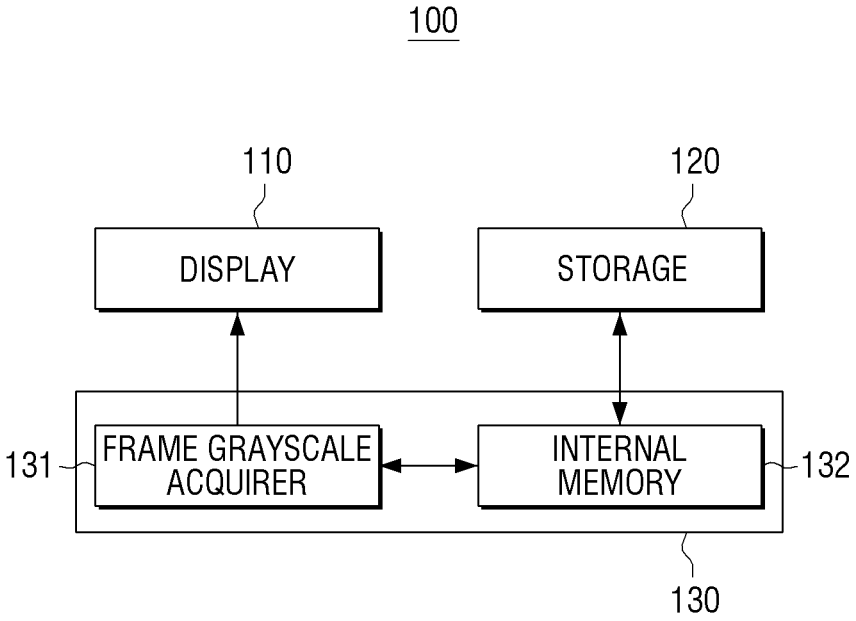
FIG. 2 is a block diagram of a display apparatus according to another exemplary embodiment.

FIG. 2 is a block diagram of a display apparatus according to another exemplary embodiment.

Referring to FIG. 2, the display apparatus 100 includes a display 110, a storage 120, and a controller 130. In this example, the controller 130 includes a frame grayscale acquirer 131 and an internal memory 132. Because an example of the display 110 and the storage 120 are described above, these examples are not redundantly explained below for the sake of brevity.

The frame grayscale acquirer 131 may obtain a grayscale of an Nth image frame. The internal memory 132 may store a history of the respective grayscales of (N−1) previous image frames before the Nth image frame.

Herein, the controller 130 may determine values of the afterimages regarding the (N−1)th image frame pixel-wise, using the afterimage modeling information based on a grayscale of the Nth image frame that is obtained through the frame grayscale acquirer 131 and the history of the respective grayscales of the (N−1) previous image frames before the Nth image frame which are stored in the internal memory 132.

Further, the controller 130 may perform a pixel-wise refresh of the pixels, when values of the afterimages regarding the (N−1)th image frame are determined to be equal to or greater than a preset critical value. As another example, the controller 130 may not perform refreshing of the pixels when the values of the afterimages regarding the (N−1)th image frame are determined to be less than a critical value.

Further, the controller 130 may display the Nth image frame by inputting the grayscale values of the Nth image frame pixel-wise after performing a refreshing operation pixel-wise.

Figure 3:
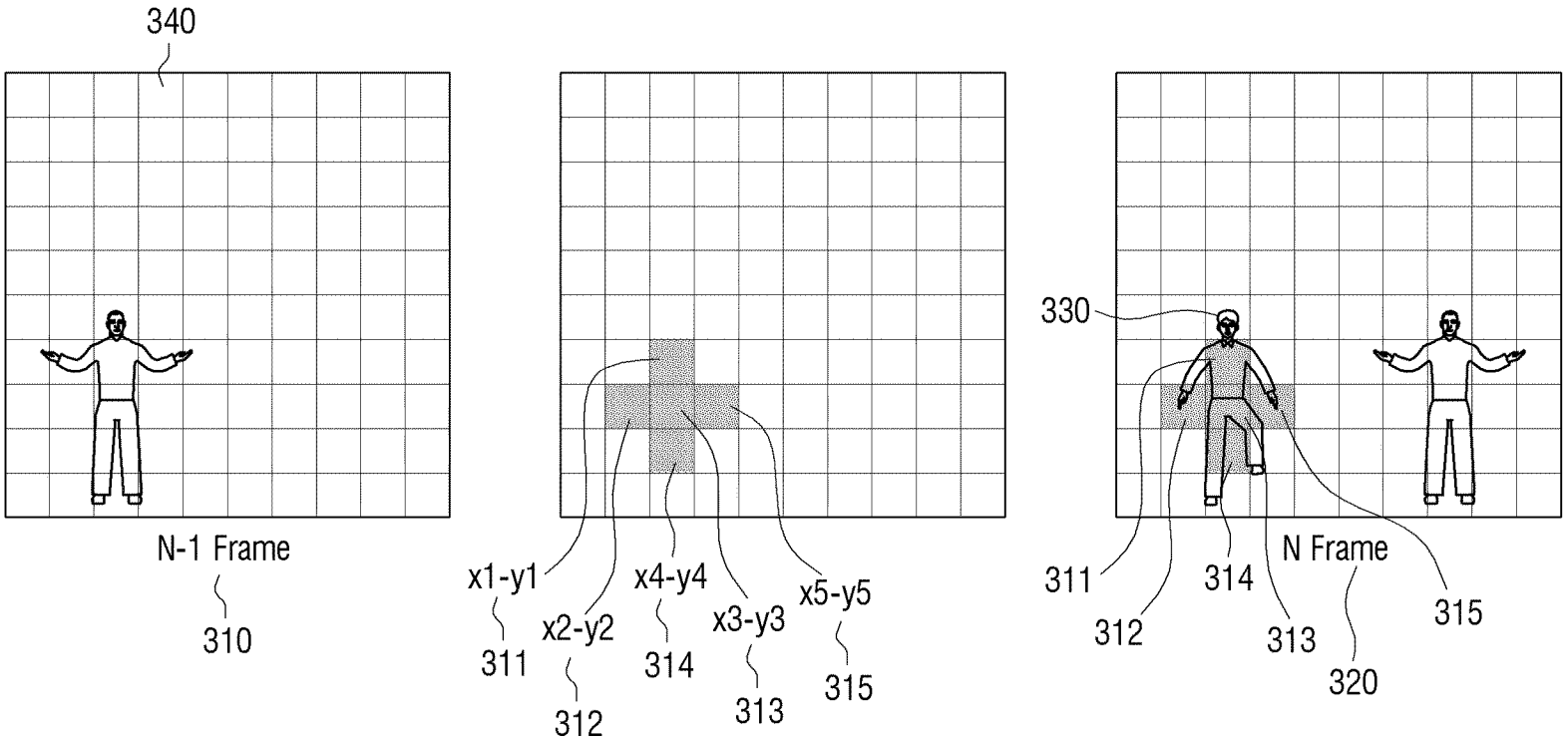
FIG. 3 is a diagram illustrating an example of a process of determining pixels for afterimage removal and displaying a current image frame after refreshing pixel-wise, according to an exemplary embodiment.

FIG. 3 below is an example of a process of pixel-wise refreshing the pixels that call for afterimage removal, and pixel-wise inputting the grayscale values of the current frame.

FIG. 3 is a diagram illustrating an example of a process of determining pixels for afterimage removal and displaying a current image frame after refreshing pixel-wise, according to an exemplary embodiment.

Referring to FIG. 3, the (N−1)th image frame 310 is converted into the Nth image frame 320. For example, a screen of the (N−1)th image frame 310 may be formed of a plurality of pixels 340, and the controller 130 may determine values of the afterimages regarding the (N−1)th image frame 310, pixel-wise, using the afterimage modeling information. In this example, the afterimage modeling information may be based on a history of the respective grayscale changes of the (N−1)th image frame 310 and the previous image frames (the first, the second, . . . , the N−2th image frame), and the grayscale of the Nth image frame 320 that is to be displayed currently.

The controller 130 may extract pixels that have values associated with afterimages that are equal to or greater than a preset critical value from among a plurality of the pixels of the (N−1)th image frame 310.

For example, the controller 130 may determine values of the afterimages that are equal to or greater than a preset critical value from among pixel 311 at x1-y1 coordinate, pixel 312 at x2-y2 coordinate, pixel 313 at x3-y3 coordinate, pixel 314 at x4-y4 coordinate, and pixel 315 at x5-y5 coordinate from among a plurality of the pixels 340.

Herein, the controller 130 may determine that a human-shaped object included in the (N−1)th frame 310 may have a high possibility of being noticeable to the eyes of a user on the Nth frame 320 using the afterimage modeling information. For example, the afterimage modeling information may be based on the history of the respective grayscale changes of the (N−1)th frame 310 and the previous frames and the grayscale of the Nth frame 320. Accordingly, the controller 130 may refresh pixel-wise regarding the pixel 311 on the x1-y1 coordinate, the pixel 312 on x2-y2 coordinate, the pixel 313 on x3-y3 coordinate, the pixel 314 on x4-y4 coordinate, and the pixel 315 on x5-y5 coordinate.

Further, the controller 130 may display the Nth image frame 330 by inputting the grayscale values of the Nth image frame 320 pixel-wise, after performing refreshing of the pixel 311 on x1-y1 coordinate, the pixel 312 on x2-y2 coordinate, the pixel 313 on x3-y3 coordinate, the pixel 314 on x4-y4 coordinate, and the pixel 315 on x5-y5 coordinate.

Referring to FIG. 3, another human-shaped object may be displayed as the grayscale values of the Nth image frame 320 that is newly input after a refresh of the pixel 311 on the x1-y1 coordinate, the pixel 312 on the x2-y2 coordinate, the pixel 313 on the x3-y3 coordinate, the pixel 314 on the x4-y4 coordinate, and the pixel 315 on the x5-y5 coordinate.

Figure 4:
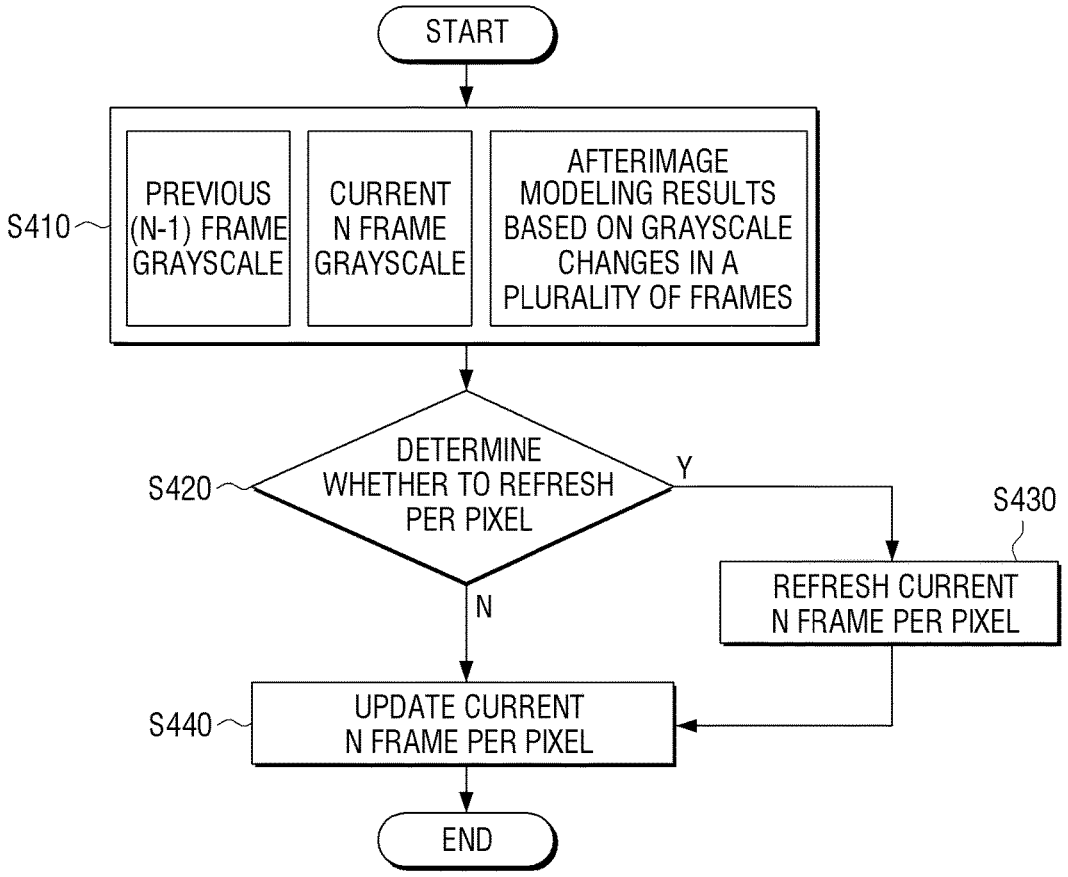
FIG. 4 is a diagram illustrating an example of a process of updating pixels of a current frame according to an exemplary embodiment.

Meanwhile, FIG. 4 is a diagram illustrating an example of a process of updating pixels of a current frame according to an exemplary embodiment.

Referring to FIG. 4, when the grayscales of the previous (N−1) frames and the grayscale of the current N frame are input to the afterimage modeling information, the afterimage modeling results may be calculated based on grayscale changes in the plurality of frames, at S410.

The controller 130 may determine whether to refresh pixels according to the afterimage modeling results, at S420. For example, the controller 130 may determine pixels that are to be refreshed when the values of the afterimages of the (N−1)th image frame are determined to be equal to or greater than a preset critical value according to the afterimage modeling results.

Further, when determining whether the values of the afterimages of the (N−1)th image frame are equal to or greater than a preset critical value, the controller 130 may refresh the pixels of the current Nth frame which have values of afterimages that are determined to be equal to or greater than a preset critical value from among a plurality of the pixels, at S430. Further, the controller 130 may update the grayscale values pixel-wise of the current Nth image frame, at S440.

Meanwhile, when the values of the afterimages of the (N−1)th image frame are less than a preset critical value, the controller 130 may determine not to perform a refresh. Accordingly, the controller 130 may not refresh pixels that have values of afterimages that are determined to be less than a preset critical value from among a plurality of the pixels the current frame (i.e. Nth frame), and update the grayscale values pixel-wise of the current frame, at S440.

Regarding the grayscales that are input pixel-wise, the controller 130 may determine whether or not to use the values classified by a preset standard, for example, based on the grayscale of the current image frame, the history of the respective grayscales of the previous image frames, and the afterimage modeling information.

For example, the controller 130 may modify the grayscale values of the pixels within the current image frame using the afterimages without removing the afterimages occurring pixel-wise, in response to the grayscale values being updated pixel-wise regarding the current image frame. Herein, the grayscale values may be varied by using the afterimages, and may express the middle grayscale values that cannot be expressed with n bits, as in the case of the related art.

For example, when n is equal to 8, the middle grayscale values that can be expressed by the related art (i.e., with 8 bits) are 128 and 144. However, the grayscale value of 136 may not be expressed with 8 bits. Accordingly, when the grayscale value of the original image frame is 136, the grayscale value of 128 or 144 may be input instead of 136.

However, because the controller 130 according to various exemplary embodiments can use the afterimages occurring pixel-wise, the grayscale value of the original image frame may be input regarding the pixels within the current image frame, an example of which is described with respect to FIG. 6.

FIG. 6 is a diagram illustrating an example of middle grayscale values expressed using the afterimages according to an exemplary embodiment.

Referring to FIG. 6, Case 1 is an example in which one of a plurality of the pixels of the previous image frame is refreshed, and then 128 is input as a grayscale value of the current image frame. In this example, a bar graph 610 indicates that the input grayscale of the previous image frame is 0 because of it being refreshed, and the grayscale of the current image frame to be updated is 128. Also, because the grayscale of the current image frame is updated, the measured brightness value is 115.2 and the updated grayscale value is 128.

Case 2 is an example in which one of a plurality of the pixels of the previous image frame is refreshed, and 144 is input as grayscale value of the current image frame. In this example, a bar graph 620 indicates that the input grayscale of the previous image frame is 0 because of it being refreshed, and the grayscale of the current image frame to be updated is 144. Also, because the grayscale of the current image frame is updated, the measured brightness value is 123.5, and the updated grayscale value is 144.

Case 1 and Case 2 illustrate examples in which the grayscales input pixel-wise correspond to the values that are classified by a preset standard. FIG. 6 illustrates that the values classified by a preset standard may be expressed as quantized values. Thus, in the examples of Case 1 and Case 2, the grayscale values may be expressed to be specific values such as 0, 16, 32, . . . , 128, and 144.

Meanwhile, Case 3 illustrates an example in which 128 is input as a grayscale value of the current image frame while a plurality of the pixels of the previous image frame are kept, i.e., without refreshing any pixel. In this example, a bar graph 630 indicates that the input grayscale of the previous image frame is 144 because the refresh is not performed, and the grayscale of the current image frame to be updated is 128. Also, the measured brightness value is 118.8 by inputting 128 as grayscale of the current image frame regarding 144 which is the input grayscale of the previous image frame, and the updated grayscale value is 136.

When comparing Case 1 with Case 3, Case 1 has 128 which is input as a grayscale of the current image frame while the grayscale of the previous value is refreshed to 0. Meanwhile, Case 3 has 128 which is input as a grayscale of the current image frame while the input grayscale of the previous frame is not refreshed and kept at 144. As a result, a value of 128 may be input which is a value classified by a preset standard according to Case 1, while 136 may be input which is value that is not classified by a preset standard according to Case 3.

Accordingly, the controller 130 may express the grayscale with the values that are not classified by a preset standard, using the afterimages occurring frame-wise instead of removing the same.

Also, when the values classified by a preset standard are used regarding the grayscales input pixel-wise, the controller 130 may refresh the pixels that are in need of afterimage removal in each image frame pixel-wise. Therefore, when the values classified by a preset standard are not used regarding the grayscales input pixel-wise, the controller 130 may update the pixels that have afterimages that occur in each image frame using the afterimages with the values that are not classified by a preset standard.

Herein, the controller 130 may update the pixels that have the afterimages occurring in each image frame with the values that are not classified by a preset standard based on the values that are associated with the afterimages and the grayscale of the current frame.

Thus, the controller 130 may express the middle grayscale values that are not classified by a preset standard, by combining the values associated with the afterimages and the grayscale values of the image frame that are to be displayed currently, regarding the pixels in which afterimages occur in each image frame.

Figure 5:
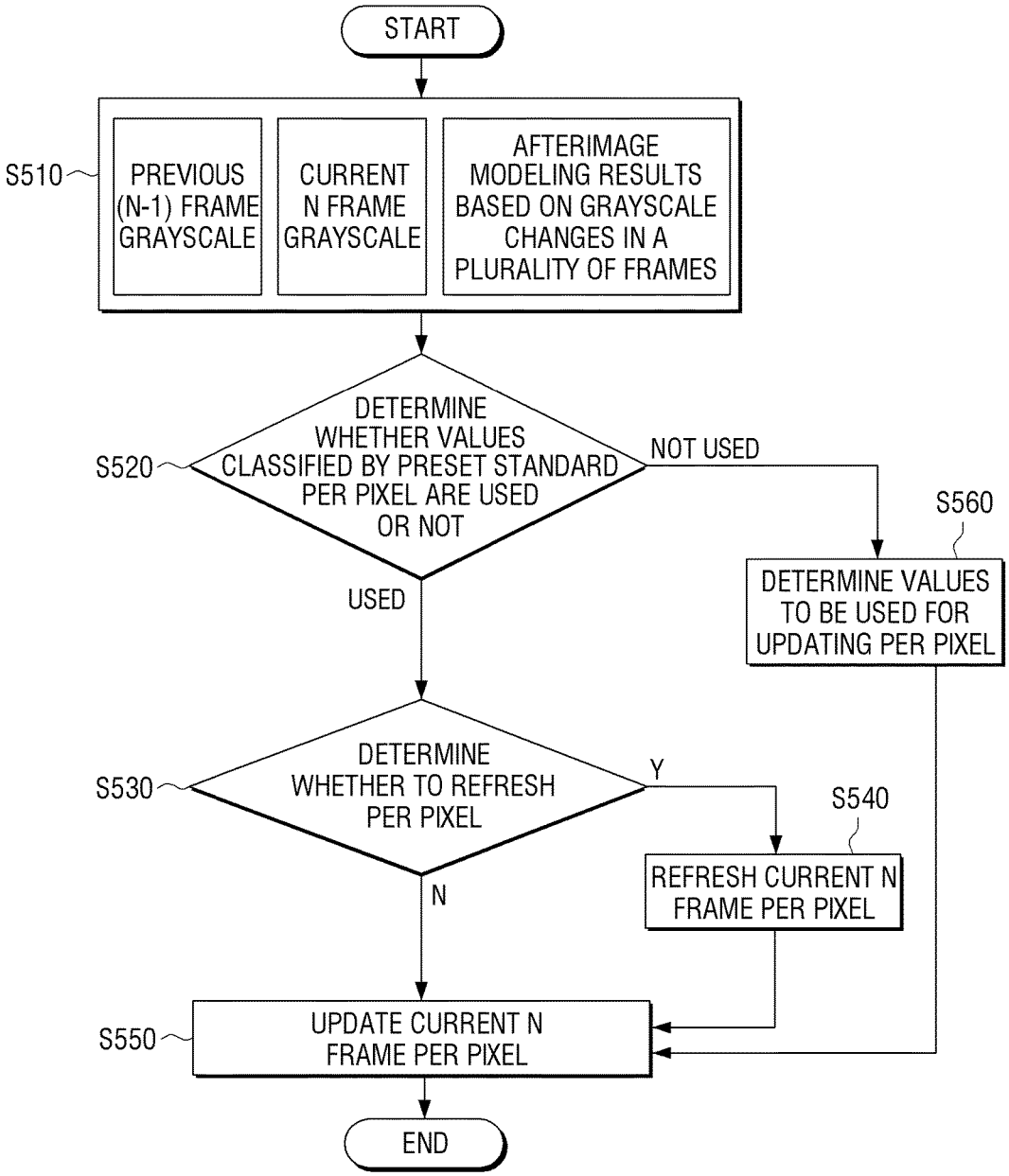
FIG. 5 is a diagram illustrating an example of processes of updating pixels of a current frame in a case in which grayscale values classified by a preset standard are used, and another case in which the preset grayscale values are not used, according to various exemplary embodiments.

FIG. 5 is a diagram illustrating an example of processes of updating pixels of a current frame in which values classified by a preset standard are used regarding the grayscale and another case in which the above values are not used, according to various exemplary embodiments.

Referring to FIG. 5, the controller 130 may calculate afterimage modeling results by inputting the grayscale of the previous (N−1) frames and the grayscale of the current frame (Nth frame) to the afterimage modeling information based on the grayscale changes in a plurality of the frames, at S510.

At S520, the controller 130 may determine pixel-wise whether to use the values that are classified by a preset standard based on the calculated afterimage modeling results.

For example, when the values classified by a preset pixel are determined to be used pixel-wise, the controller 130 may determine whether the refresh is necessary pixel-wise according to the calculated modeling results, at S530. For example, the controller 130 may determine that the refresh is to be performed for the pixels having the values of the afterimages regarding the (N−1)th image frame that are determined to be equal to or greater than a preset critical value, according to the afterimage modeling results.

Further, the controller 130 may determine that the refresh is to be performed when the values of the afterimages regarding the (N−1)th image frame are equal to or greater than a preset value. In this example, the controller 130 may refresh the pixels that have values of the afterimages that are equal to or greater than a preset critical value from among a plurality of the pixels of the current Nth frame, at S540, and update the grayscale values pixel-wise regarding the current Nth frame, at S550.

Meanwhile, the controller 130 may determine that the refresh is not to be performed when the values of the afterimages regarding the (N−1)th image frame are less than a preset critical value. For example, the controller 130 may not refresh the pixels that have the values of the afterimages that are less than a preset critical value from among a plurality of the pixels of the current Nth frame, and update the grayscale values pixel-wise regarding the current Nth frame, at S550.

Meanwhile, when determining not to use the values classified by a preset standard pixel-wise, the controller 130 may determine the values to be used for updating pixel-wise, using the values which are not classified by a preset standard. For example, the controller 130 may determine values to be used based on the values of the afterimages and the grayscale of the current frame of the pixels having the afterimages occurring in each image frame, at S560.

Thereafter, the controller 130 may update pixel-wise regarding the current Nth frame with the determined values, at S550.

According to the above example, the display apparatus 100 according to an exemplary embodiment may perform natural screen conversion, by performing the refresh pixel-wise and thus reduce the flickering of the screen, and display grayscales that cannot be expressed with the n bits unlike in the case of a related art.

Further, the above described operation of the controller 130 may be used for expressing red (R), green (G), and blue (B) colors as well as expressing gray scale colors. For example, in addition to white and black particles, particles respectively expressing R, G, and B colors may be inserted into each pixel of the display of an electrophoretic display apparatus. Otherwise, particles expressing grayscale colors and R, G, and B colors together may be inserted and implemented, or R, G, and B color filters may be attached and implemented pixel-wise.

Furthermore, the operation of the controller 130 and/or the operation performed by the frame grayscale acquirer 131 and the internal memory 132 included in the controller 130 may be implemented to be programs, and such programs may be stored within the internal memory 132 of the controller 130.

Figure 7:
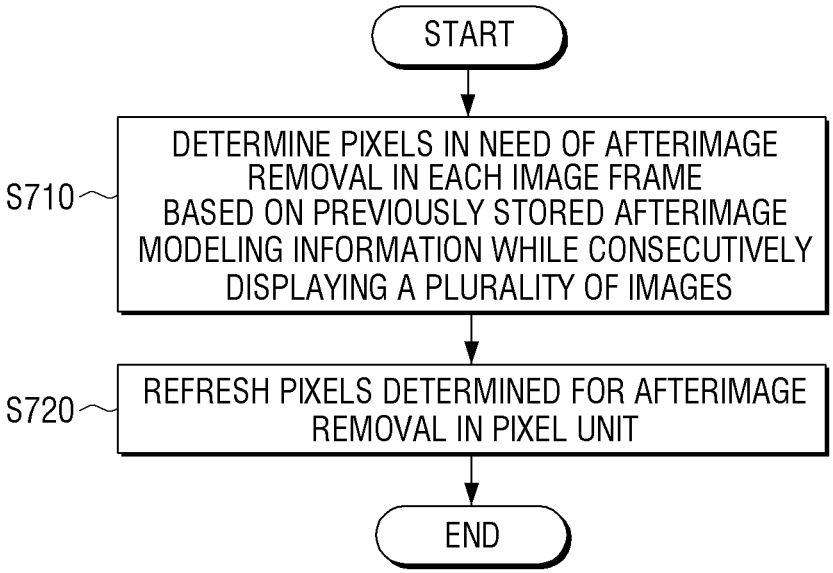
FIG. 7 is a flowchart illustrating a method of controlling the display apparatus according to an exemplary embodiment.

FIG. 7 is a flowchart illustrating an example of a method of controlling the display apparatus according to an exemplary embodiment.

Referring to FIG. 7, at S710, a plurality of images are consecutively displayed and the pixels in need of afterimage removal in each image frame are determined based on the previously stored afterimage modeling information. For example, pixels referred to as "in need" of afterimage removal may be pixels which are determined to have a probability of an afterimage that is visible to a user being above a threshold value.

At S720, the pixels determined for afterimage removal are removed pixel-wise. For example, the determining operation may determine the afterimages of the previous image frames pixel-wise based on the afterimage modeling information while a plurality of image frames are consecutively displayed and each image frame is converted. In this example, the process of refreshing may include refreshing only the pixels in need of afterimage removal according to the determined results.

According to one or more exemplary embodiments, the afterimage modeling information may indicate modeling of values of afterimages that are calculated frame-wise based on grayscale changes that can occur frame-wise.

According to one or more exemplary embodiments, a determining operation may determine values of the afterimages of previous image frames pixel-wise using the afterimage modeling information based on a grayscale of a current image frame and a history of respective grayscales of previous image frames.

According to one or more exemplary embodiments, the process of refreshing may refresh the respective pixels only in which the values of the afterimages of the previous image frames are equal to or greater than a preset critical value in a pixel-wise fashion.

According to one or more exemplary embodiments, the controlling method of the display apparatus may further include determining whether values classified by a preset standard are used or not regarding grayscales that are input pixel-wise based on a grayscale of the current image frame, the history of the respective grayscales of the previous image frames, and the afterimage modeling information.

According to one or more exemplary embodiments, the controlling method may further include a process of refreshing the pixels in need of afterimage removal pixel-wise in each image frame in response to values classified by a preset standard being used regarding the grayscales input pixel-wise. The method may also include updating with values which are not classified by a preset standard using the afterimages regarding the pixels having the afterimages occurring in each image frame when the values classified by a preset standard are not used regarding the grayscales input pixel-wise.

Meanwhile, a non-transitory computer readable recording medium storing the programs for performing the controlling methods described herein according to various exemplary embodiments may be provided.

For example, the method for performing consecutively displaying a plurality of images and determining pixels in need of afterimage removal in each image frame based on the previously stored afterimage modeling information, and refreshing the pixels in need of afterimage removal pixel-wise, may be stored in the non-transitory computer readable recording medium.

For example, the non-transitory computer readable recording medium may include a medium which stores data permanently or semi-permanently and can be read by devices, rather than a medium storing data temporarily such as register, cache, or memory. For example, the above various applications or programs may be stored and provided in non-transitory computer readable recording medium such as CD, DVD, hard disk, Blu-ray disk, USB, memory card, or ROM.

The above described exemplary block diagrams regarding the display apparatus do not illustrate a bus; but it should be appreciated that communication between the units in the display apparatus may be performed through the bus. Further, each device may include one or more processors such as a CPU and a micro processor performing the above various processes.

The foregoing exemplary embodiments and advantages are merely exemplary and are not to be construed as limiting the exemplary embodiments. The present teaching can be readily applied to other types of apparatuses. Also, the description of the exemplary embodiments of the present inventive concept is intended to be illustrative only, and not to limit the scope of the claims.

What is claimed is:

1. A display apparatus comprising:

a display including a screen having a plurality of pixels;

a storage configured to store afterimage modeling information comprising afterimage information based on grayscale changes in a plurality of N image frames; and a processor configured to:

control the display to consecutively display the plurality of N image frames on the screen, identify values of afterimages of each of a plurality of pixels of a previous (N−1)th image frame, using the afterimage modeling information based on a grayscale of a current Nth image frame and a history of respective grayscales of previous (N−1) image frames, identify pixels with afterimages among the plurality of pixels of the (N−1)th image frame based on the identified values of afterimages, and control the display to refresh pixels included in the plurality of pixels of the screen and corresponding to the identified pixels for afterimage removal in the plurality of pixels of the (N−1)th image frame.

2. The display apparatus of claim 1, wherein, while the plurality of N image frames are consecutively displayed and the respective image frames are converted, the processor is configured to determine afterimages of the previous (N−1) image frames pixel-wise based on the afterimage modeling information, and control the display to refresh pixels included in the plurality of pixels of the screen and corresponding to pixels determined for afterimage removal according to the determined results.

3. The display apparatus of claim 2, wherein the afterimage modeling information comprises models of values associated with afterimages that are calculated frame-wise based on grayscale changes that can occur frame-wise.

4. The display apparatus of claim 1, wherein the processor is configured to control the display to pixel-wise refresh pixels that have values of afterimages in the previous (N−1)th image frame that are equal to or greater than a preset critical value.

5. The display apparatus of claim 4, wherein the processor is configured to display the current Nth image frame by inputting grayscale values of the current Nth image frame pixel-wise after the pixel-wise refreshing.

6. The display apparatus of claim 1, wherein the processor is configured to obtain the grayscale of the current Nth image frame; and the display apparatus further comprises a memory configured to store the history of respective grayscales of the previous (N−1) image frames displayed before the current Nth image frame.

7. The display apparatus of claim 1, wherein the processor is configured to determine whether grayscale values classified by a preset standard are used or not regarding grayscales input pixel-wise, based on the grayscale of the current Nth image frame, the history of respective grayscales of the previous (N−1) image frames, and the afterimage modeling information.

8. The display apparatus of claim 7, wherein the processor is configured to pixel-wise refresh pixels included in the plurality of pixels of the screen and corresponding to pixels for afterimage removal in each image frame, in response to the values classified by the preset standard being used regarding the grayscales input pixel-wise.

9. The display apparatus of claim 8, wherein, in response to the values classified by the preset standard not being used regarding the grayscales input pixel-wise, the processor is configured to update pixels which have afterimages occurring in each image frame, to values which are not classified by the preset standard using the afterimages.

10. The display apparatus of claim 9, wherein the processor is configured to update the pixels in which afterimages occur in each image frame with the values which are not classified by the preset standard based on the values of the afterimages and the grayscale of the current Nth image frame.

11. A controlling method of a display apparatus, the method comprising:

displaying a plurality of N image frames consecutively on a screen having a plurality of pixels;

identifying values of afterimages of each of a plurality of pixels of a previous (N−1)th image frame, using afterimage modeling information based on a grayscale of a current Nth image frame and a history of respective grayscales of previous (N−1) image frames;

identifying pixels with afterimages among the plurality of pixels of the previous (N−1)th image frame based on the identified values of afterimages; and refreshing pixels included in the plurality of pixels of the screen and corresponding to the identified pixels for afterimage removal in the plurality of pixels of the (N−1)th image frame.

12. The controlling method of claim 11, wherein, while the plurality of N image frames are consecutively displayed and each image frame is converted, the identifying the values of afterimages comprises determining afterimages of the previous (N−1) image frames pixel-wise based on the afterimage modeling information, and the refreshing comprises refreshing pixels included in the plurality of pixels of the screen and corresponding to pixels determined for afterimage removal according to the determined results.

13. The controlling method of claim 12, wherein the afterimage modeling information comprises models of values of afterimages calculated frame-wise based on the grayscale changes that can occur frame-wise.

14. The controlling method of claim 13, wherein the refreshing pixel-wise comprises refreshing pixels included in the plurality of pixels of the screen and corresponding to pixels which have values of afterimages in the previous (N−1)th image frame that are equal to or greater than a preset critical value.

15. The controlling method of claim 14, further comprising:

after refreshing pixel-wise, displaying the current Nth image frame by inputting the grayscale values of the current Nth image frame pixel-wise.

16. The controlling method of claim 11, further comprising:

determining whether grayscale values classified by a preset standard are used or not for grayscales input pixel-wise based on the grayscale of the current Nth image frame, history of respective grayscales of the previous (N−1) image frames, and the afterimage modeling information.

17. The controlling method of claim 16, further comprising:

pixel-wise refreshing pixels included in the plurality of pixels of the screen and corresponding to pixels determined for afterimage removal in each image frame in response to the grayscale values classified by the preset standard being used for the grayscales input pixel-wise; and updating the pixels having the afterimages occurring, with grayscale values which are not classified by the preset standard, by using the afterimages, in response to the grayscale values classified by the preset standard not being used for the grayscales input pixel-wise.

* * * * *